US012274925B2

(12) United States Patent
Motokawa et al.

(10) Patent No.: US 12,274,925 B2
(45) Date of Patent: Apr. 15, 2025

(54) GOLF CLUB

(71) Applicant: Sumitomo Rubber Industries, Ltd., Hyogo (JP)

(72) Inventors: Yuki Motokawa, Kobe (JP); Daisuke Kohno, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 430 days.

(21) Appl. No.: 17/198,787

(22) Filed: Mar. 11, 2021

(65) Prior Publication Data

US 2021/0362014 A1 Nov. 25, 2021

(30) Foreign Application Priority Data

May 19, 2020 (JP) ..... 2020-087763

(51) Int. Cl.
*A63B 53/10* (2015.01)
*A63B 53/04* (2015.01)

(52) U.S. Cl.
CPC ..... *A63B 53/10* (2013.01); *A63B 53/0412* (2020.08); *A63B 53/0466* (2013.01); *A63B 53/047* (2013.01); *A63B 53/0487* (2013.01); *A63B 2209/02* (2013.01)

(58) Field of Classification Search
CPC ..... A63B 53/00; A63B 53/04; A63B 53/10; A63B 53/12
USPC ..... 473/304–350
See application file for complete search history.

(56) References Cited

U.S. PATENT DOCUMENTS

| | | | | | |
|---|---|---|---|---|---|
| 5,681,228 | A * | 10/1997 | Mikame | A63B 53/04 | 473/330 |
| 6,254,494 | B1 * | 7/2001 | Hasebe | A63B 53/04 | 473/345 |
| 10,420,995 | B2 * | 9/2019 | Takasu | A63B 60/42 | |
| 10,994,180 | B2 * | 5/2021 | Takasu | A63B 53/14 | |
| 2004/0048681 | A1 | 3/2004 | Nishio | | |
| 2008/0004127 | A1 * | 1/2008 | Takeuchi | A63B 53/10 | 473/316 |
| 2012/0264536 | A1 * | 10/2012 | Yashiki | A63B 53/10 | 473/323 |
| 2019/0009148 | A1 | 1/2019 | Takasu et al. | | |
| 2019/0009149 | A1 | 1/2019 | Mizutani et al. | | |
| 2019/0009154 | A1 * | 1/2019 | Mizutani | A63B 60/08 | |
| 2019/0009155 | A1 * | 1/2019 | Mizutani | A63B 60/42 | |

(Continued)

FOREIGN PATENT DOCUMENTS

| | | | | |
|---|---|---|---|---|
| AU | 2012241086 B9 * | 7/2014 | | A63B 53/00 |
| JP | 11057089 A * | 3/1999 | | |
| JP | 2000084124 A * | 3/2000 | | A63B 53/04 |

(Continued)

*Primary Examiner* — Alvin A Hunter
(74) *Attorney, Agent, or Firm* — Studebaker Brackett PLLC

(57) ABSTRACT

A golf club includes a head, a shaft, and a grip. The head has a center-of-gravity depth of greater than or equal to 23.5 mm. The head has a center-of-gravity distance of less than or equal to 39 mm. The shaft has a forward flex of greater than or equal to 110 mm. When f1 denotes the forward flex of the shaft and f2 denotes a backward flex of the shaft, f2/f1 may be greater than or equal to 0.8 and less than or equal to 0.9. The head may have a volume of greater than or equal to 380 cc. The shaft may have a weight of less than or equal to 50 g.

16 Claims, 8 Drawing Sheets

(56) References Cited

U.S. PATENT DOCUMENTS

| | | | | |
|---|---|---|---|---|
| 2020/0338415 | A1* | 10/2020 | Takasu | A63B 60/42 |
| 2021/0362014 | A1* | 11/2021 | Motokawa | A63B 53/00 |

FOREIGN PATENT DOCUMENTS

| | | | | | |
|---|---|---|---|---|---|
| JP | 2004081344 | A | * | 3/2004 | A63B 53/00 |
| JP | 2009-268835 | A | | 11/2009 | |
| JP | 6303159 | B1 | * | 4/2018 | A63B 1/00 |
| JP | 2019-013458 | A | | 1/2019 | |
| JP | 2019-013616 | A | | 1/2019 | |
| JP | 2019162322 | A | * | 9/2019 | A63B 53/04 |
| JP | 6648853 | B1 | * | 2/2020 | A63B 53/14 |
| JP | 2020182523 | A | * | 11/2020 | A63B 53/14 |
| KR | 20060066598 | A | * | 6/2006 | |
| KR | 20080058153 | A | * | 6/2008 | |
| KR | 101882747 | B1 | * | 8/2018 | |

* cited by examiner

GOLF CLUB

The present application claims priority on Patent Application No. 2020-87763 filed in Japan on May 19, 2020. The entire contents of this Japanese Patent Application are hereby incorporated by reference.

BACKGROUND OF THE INVENTION

Field of the Invention

The present disclosure relates to a golf club.

Description of the Related Art

JP6305611B1 (US2019/0009155A1) discloses a golf club having a forward club flex of greater than or equal to 170 mm. In this club, a shaft bends during a swing, whereby a club swing path closer to a golfer's body can be achieved. As a result, the swing rotation speed increases, whereby the head speed can be improved.

SUMMARY OF THE INVENTION

However, it has been found out that, although enhancing the bending of a shaft contributes to improvement of the head speed, it causes a face of the head to be likely to open at impact. The present disclosure provides a golf club that can suppress face opening at impact while achieving an improved head speed.

In one aspect, the present disclosure provides a golf club head including a head, a shaft, and a grip. The head has a center-of-gravity depth of greater than or equal to 23.5 mm. The head has a center-of-gravity distance of less than or equal to 39 mm. The shaft has a forward flex of greater than or equal to 110 mm.

DESCRIPTION OF THE PREFERRED EMBODIMENTS (Findings on which the Present Disclosure is Based)

The inventors of the present disclosure have found out that, although setting a large forward flex is effective in increasing the head speed, it causes a face to be likely to open at impact. In light of the foregoing, the inventors conducted in-depth studies to develop a golf club in which face opening at impact is unlikely to occur whereas an increased head speed is achieved. In the course of these studies, the inventors have found out that phenomena called back-down and toe-down are caused according to the position of the center of gravity of a head. The inventors have also found out that the face opening can be suppressed by utilizing these phenomena. The present disclosure is based on these new findings.

The present disclosure will be described in detail on the basis of preferred embodiments with reference to the drawings as necessary.

In the present disclosure, a reference state, a reference perpendicular plane, a toe-heel direction, a face-back direction, an up-down direction, and a face center are defined.

Figure 7:
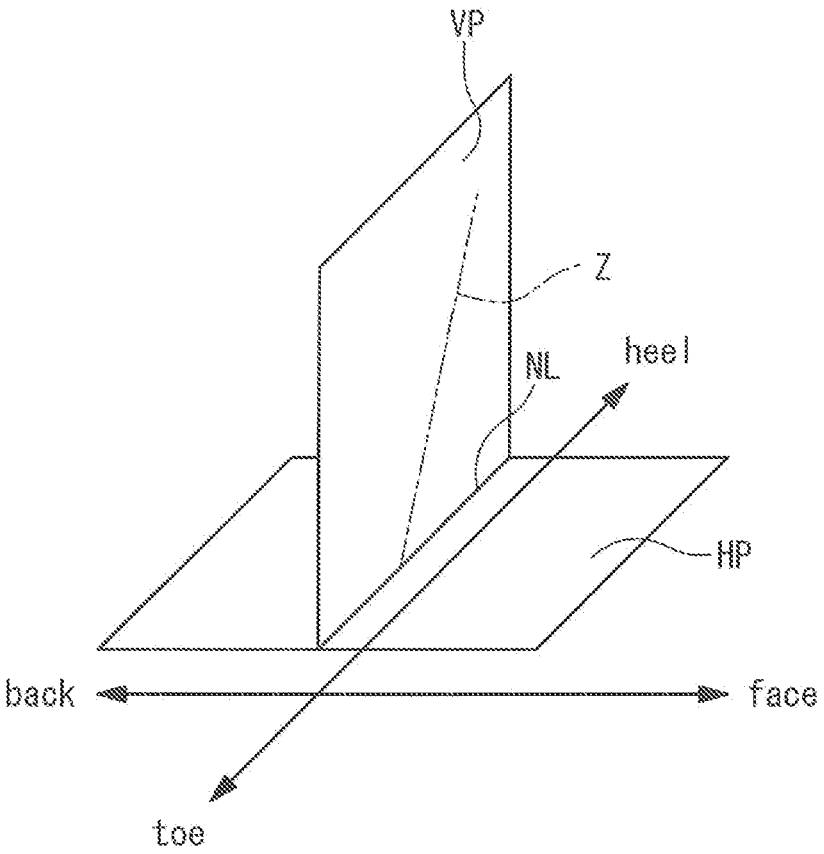
FIG. 7 is a diagram illustrating a toe-heel direction and a face-back direction.

The reference state is a state where a head is placed at a predetermined lie angle on a horizontal plane HP. As shown in FIG. 7, in the reference state, a plane VP perpendicular to the horizontal plane HP wholly includes a center line Z of a shaft. The plane VP is defined as the reference perpendicular plane. The predetermined lie angle is shown in product catalogues, for example.

In this reference state, a hook angle is set to 0 degrees. That is, in a plan view as viewed from above, a tangent line to the head at its face center is set to be parallel to the toe-heel direction. The definitions of the face center and the toe-heel direction are as described below.

In the present disclosure, the toe-heel direction is a direction in which an intersection line NL between the reference perpendicular plane VP and the horizontal plane HP extends (see FIG. 7).

In the present disclosure, the face-back direction is a direction perpendicular to the toe-heel direction and parallel to the horizontal plane HP (see FIG. 2 to be described below).

In the present disclosure, the up-down direction is a direction perpendicular to the toe-heel direction and perpendicular to the face-back direction. In other words, the up-down direction in the present disclosure is a direction perpendicular to the horizontal plane HP.

In the present disclosure, the face center is determined in the following manner. First, a point Pr is selected roughly at the center of a hitting face in the up-down direction and the toe-heel direction. Next, a plane that passes through the point Pr, extends in the direction of a line normal to the hitting face at the point Pr, and is parallel to the toe-heel direction is determined. An intersection line between this plane and the hitting face is drawn, and a midpoint Px of this intersection line is determined. Next, a plane that passes through the midpoint Px, extends in the direction of a line normal to the hitting face at the midpoint Px, and is parallel to the up-down direction is determined. An intersection line between this plane and the hitting face is drawn, and a midpoint Py of this intersection line is determined. Next, a plane that passes through the midpoint Py, extends in the direction of a line normal to the hitting face at the midpoint Py, and is parallel to the toe-heel direction is determined. An intersection line between this plane and the hitting face is drawn, and a midpoint Px of this intersection line is newly determined. Next, a plane that passes through this newly-determined midpoint Px, extends in the direction of a line normal to the hitting face at this midpoint Px, and is parallel to the up-down direction is determined. An intersection line between this plane and the hitting face is drawn, and a midpoint Py of this intersection line is newly determined. By repeating the above-described steps, points Px and Py are sequentially determined. In the course of repeating these steps, when the distance between a newly-determined midpoint Py and a midpoint Py determined in the immediately preceding step first becomes equal to or less than 0.5 mm, the newly-determined midpoint Py (the midpoint Py determined last) is defined as the face center.

Figure 1:
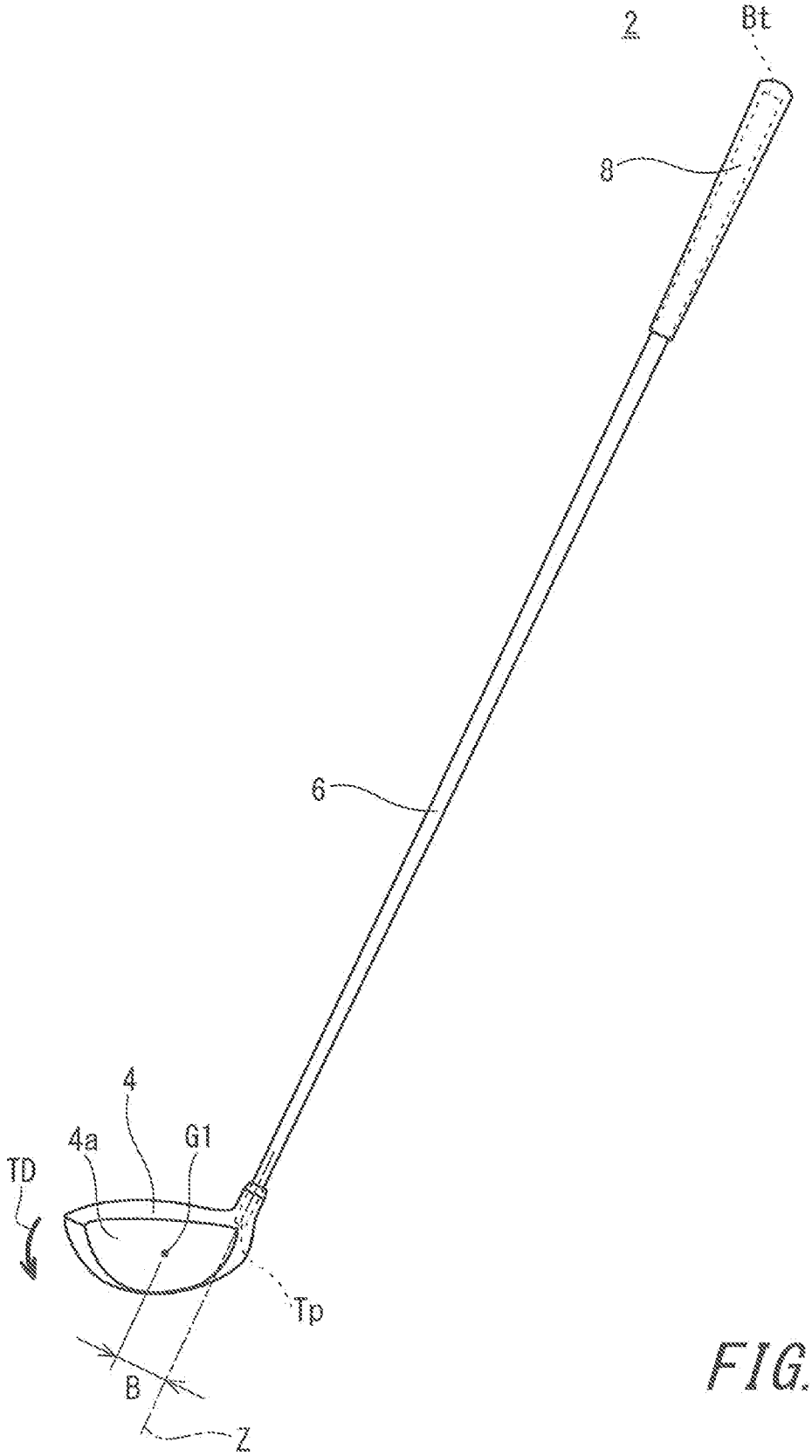
FIG. 1 shows a golf club according to one embodiment.

FIG. 1 is an overall view of a golf club 2 according to an embodiment of the present disclosure. FIG. 2 is a side view of the golf club 2 as viewed from the heel side of its head. FIG. 2 is an enlarged view showing a portion near the head only. The golf club 2 includes a golf club head 4, a shaft 6, and a grip 8. The head 4 includes a hitting face 4*a*. The hitting face 4*a* is also referred to simply as "face".

The golf club 2 is a driver (number one wood). The club length of drivers is typically greater than or equal to 43 inches. Preferably, the golf club 2 is a wood-type golf club.

The head 4 has a hollow structure. The head 4 is a wood-type head. The head 4 may be a hybrid-type (utility-type) head. The head 4 may be an iron-type head. The head 4 may be a putter-type head. The material of the head 4 may be, for example, a metal or a fiber reinforced plastic. Examples of the metal include titanium alloys, pure titanium, stainless steel, maraging steel, and soft iron. Examples of the fiber reinforced plastic include carbon fiber reinforced plastics. The head 4 may be a composite head including a portion made of a metal and a portion made of a fiber reinforced plastic.

The head 4 is attached to an end portion of the shaft 6 on a tip end Tp side. The grip 8 is attached to an end portion of the shaft 6 on a butt end Bt side.

The shaft 6 is a tubular body. The shaft 6 has a hollow structure. As shown in FIG. 1, the shaft 6 has a tip end Tp and a butt end Bt. The tip end Tp is located inside the head 4. The butt end Bt is located inside the grip 8.

The material of the shaft 6 is a carbon fiber reinforced resin. A carbon fiber reinforced resin is preferable as the material of the shaft 6 from the viewpoint of weight reduction. The shaft 6 is a so-called carbon shaft. Preferably, the shaft 6 is produced by curing a prepreg sheet. In this prepreg sheet, fibers are oriented substantially in one direction. Such a prepreg in which fibers are oriented substantially in one direction is also referred to as "UD prepreg". "UD" is an abbreviation of "unidirectional". The prepreg sheet may be made of a prepreg other than UD prepreg. For example, fibers contained in the prepreg sheet may be woven. The shaft 6 may include a metal wire. The material of the shaft 6 is not limited, and may be a metal, for example.

The prepreg sheet contains fibers and a resin. This resin is also referred to as a "matrix resin". Typically, these fibers are carbon fibers. This matrix resin is typically a thermosetting resin.

The shaft 6 is produced by a so-called sheet winding method. In the prepreg, the matrix resin is in a semi-cured state. The shaft 6 is produced by winding and curing the prepreg sheet. The shaft 6 may be produced by a filament winding method.

As the matrix resin of the prepreg sheet, for example, not only an epoxy resin but also a thermosetting resin other than the epoxy resin, and a thermoplastic resin may also be used. From the viewpoint of the shaft strength, an epoxy resin is preferable as the matrix resin.

There is no limitation on the method for producing the shaft 6. From the viewpoint of the degree of freedom in design, it is preferable to produce the shaft by a sheet winding method.

The grip 8 is a portion that a golfer grips during a swing. The material of the grip 8 may be, for example, a rubber composition or a resin composition. Examples of the rubber contained in the rubber composition include natural rubber (NR), ethylene-propylene-diene rubber (EPDM), styrene-butadiene rubber (SBR), isoprene rubber (IR), butadiene rubber (BR), chloroprene rubber (CR), and acrylonitrile-butadiene rubber (NBR). In particular, the rubber contained in the rubber composition is preferably natural rubber, or a material obtained by blending (mixing) natural rubber with a rubber having a good affinity for natural rubber, such as ethylene-propylene-diene rubber or styrene-butadiene rubber. The resin contained in the resin composition may be, for example, a thermoplastic resin. The thermoplastic resin can be used for injection forming. The thermoplastic resin is preferably a thermoplastic elastomer, and more preferably a thermoplastic elastomer containing a soft segment and a hard segment. From the viewpoint of achieving both the gripping performance and the abrasion resistance, a urethane thermoplastic elastomer is more preferable. From the viewpoint of formability, EPDM and styrene-butadiene rubber are more preferable. The rubber composition of the grip 8 may be a rubber containing air bubbles.

The head 4 has a center of gravity G1. In the present embodiment, the head center of gravity G1 is located inside (in a hollow portion of) the head 4.

In FIG. 1, a double-headed arrow B indicates a center-of-gravity distance of the head 4. The center-of-gravity distance B means a distance between the center line Z of the shaft 6 and the head center of gravity G1. The center-of-gravity distance B is not a distance measured three-dimensionally but a distance measured in a front view of the head 4. When the head is in the reference state, the center line Z of the shaft 6 and the head center of gravity G1 are projected on the reference perpendicular plane VP. The center-of-gravity distance B is a distance measured in this projection image.

Figure 2:
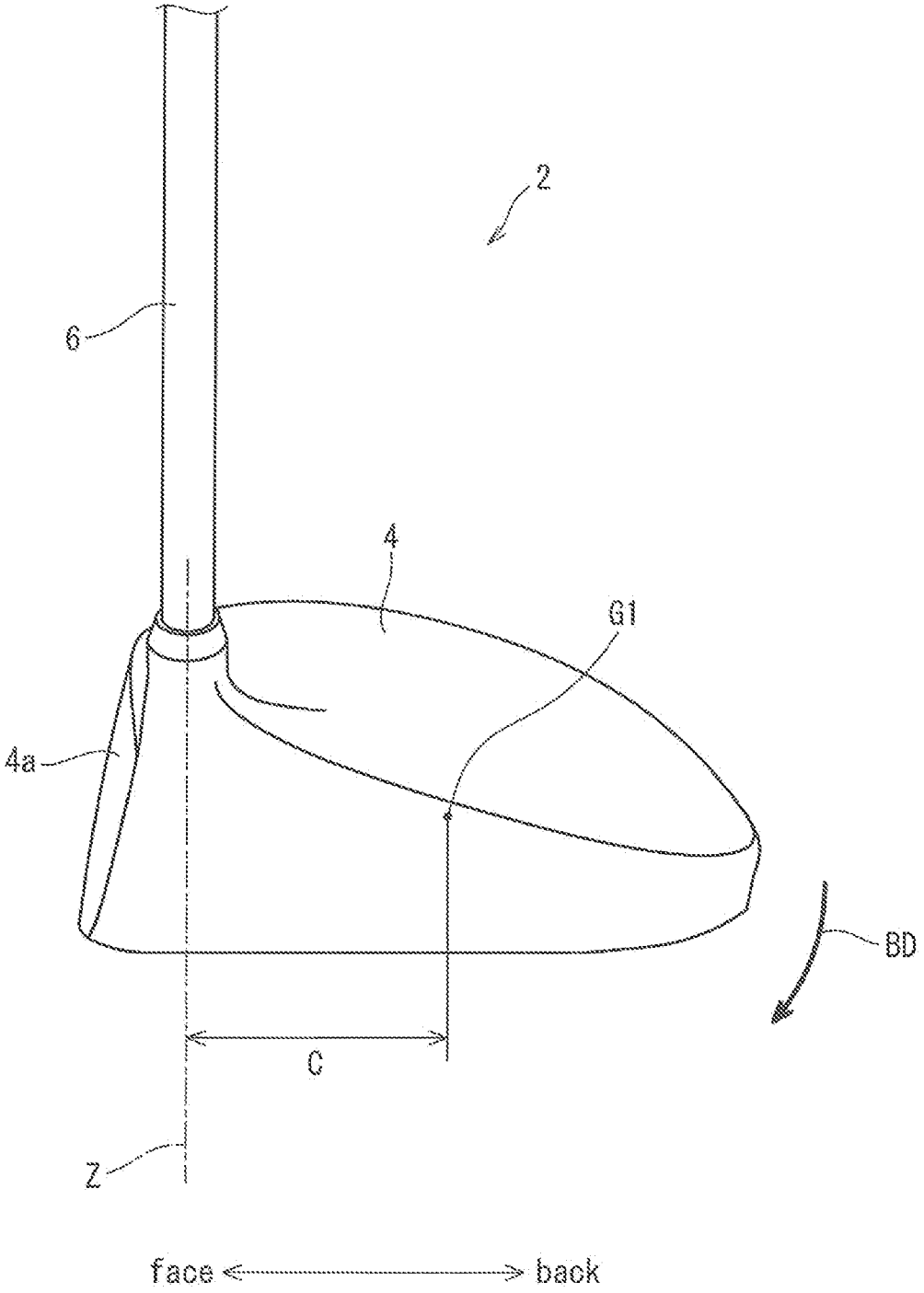
FIG. 2 is a fragmentary enlarged view of the golf club shown in FIG. 1, and shows a side view of the head as viewed from a heel side.

In FIG. 2, a double-headed arrow C indicates a center-of-gravity depth of the head 4. The center-of-gravity depth C means a distance between the center line Z of the shaft 6 and the head center of gravity G1. The center-of-gravity depth C is measured in the face-back direction.

The shaft 6 has a forward flex f1 and a backward flex f2. The forward flex f1 and the backward flex f2 are specifications relating to the flexural rigidity of the shaft.

Figure 3A:
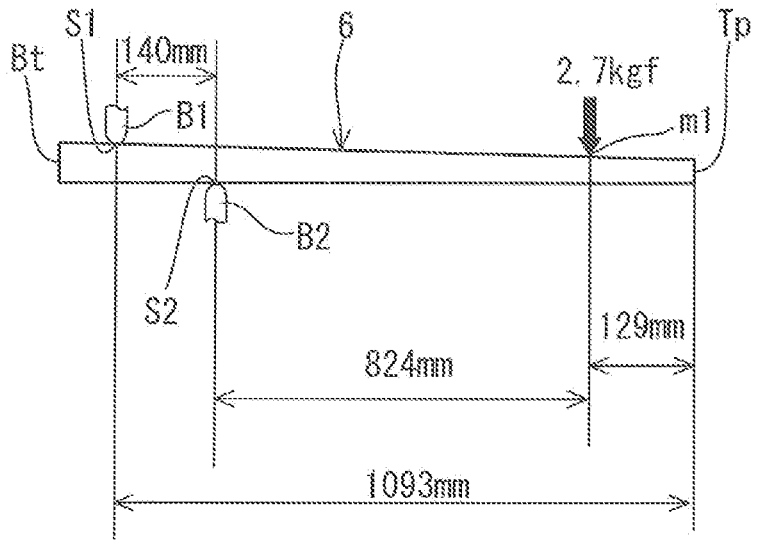
FIG. 3A is a schematic diagram illustrating a method for measuring a forward flex.

FIG. 3A illustrates a method for measuring the forward flex f1. As shown in FIG. 3A, a first support point S1 is set at a position spaced 1093 mm apart from the tip end Tp. Further, a second support point S2 is set at a position spaced 953 mm apart from the tip end Tp. A support B1 that supports the shaft 6 from above is provided at the first support point S1. A support B2 for supporting the shaft 6 from below is provided at the second support point S2. The shaft axis line of the shaft 6 extends horizontally in the state where no load is applied to the shaft 6. At a load point m1 that is spaced 129 mm apart from the tip end Tp, a load of 2.7 kgf is applied vertically downward. The forward flex f1 is the distance (mm) between the load point m1 in the state where no load is applied and the load point m1 in the state where the shaft is stabilized under application of the load. This distance is measured in the vertical direction.

Of the support B1, a portion to be in contact with the shaft (hereinafter referred to as "contact portion") has a cross-sectional shape as described below. When viewed in a cross section parallel to the shaft axial direction, the cross-sectional shape of the contact portion of the support B1 has convex roundness. The radius of curvature of this roundness is 15 mm. When viewed in a cross section perpendicular to the shaft axial direction, the cross-sectional shape of the contact portion of the support B1 has concave roundness. The radius of curvature of this concave roundness is 40 mm. When viewed in the cross section perpendicular to the shaft axial direction, the length of the contact portion of the support B1 in the horizontal direction (the length in the depth direction of the figure in FIG. 3A) is 15 mm. The contact portion of the support B2 has the same cross-sectional shape as the contact portion of the support B1. The cross-sectional shape of the contact portion of a load indenter (not shown) applying the load of 2.7 kgf at the load point m1 has convex roundness when viewed in the cross section parallel to the shaft axial direction. The radius of curvature of this roundness is 10 mm. The cross-sectional shape of the contact portion of the load indenter (not shown) applying the load of 2.7 kgf at the load point m1 is a straight line when viewed in the cross section perpendicular to the shaft axial direction. This straight line has a length of 18 mm. A weight including the load indenter is suspended at the load point m1.

Figure 3B:
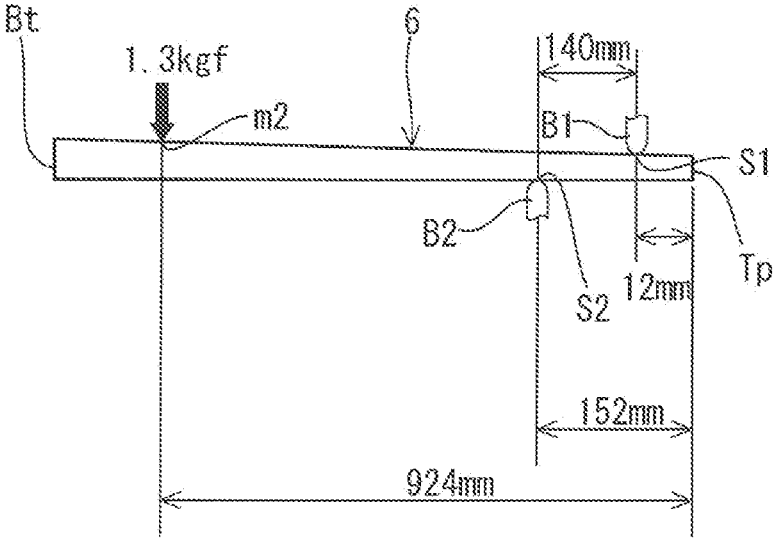
FIG. 3B is a schematic diagram illustrating a method for measuring a backward flex.

FIG. 3B illustrates a method for measuring the backward flex f2. The method for measuring the backward flex is the same as the above-described method for measuring the forward flex, except that the first support point S1 is set at a position spaced 12 mm apart from the tip end Tp, the second support point S2 is set at a position spaced 152 mm apart from the tip end Tp, a load point m2 is set at a position spaced 924 mm apart from the tip end Tp, and the load is set to 1.3 kgf.

Figure 4:
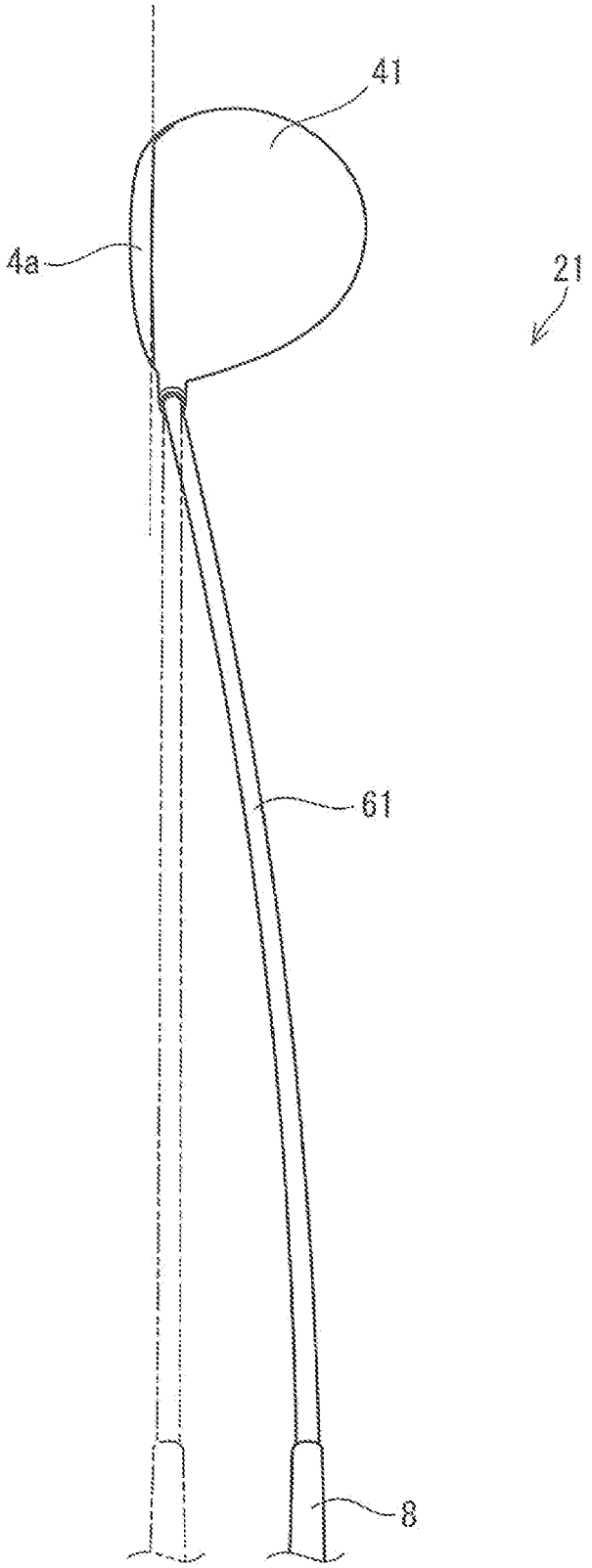
FIG. 4 is a conceptual diagram showing an example of ideal impact.
Figure 5:
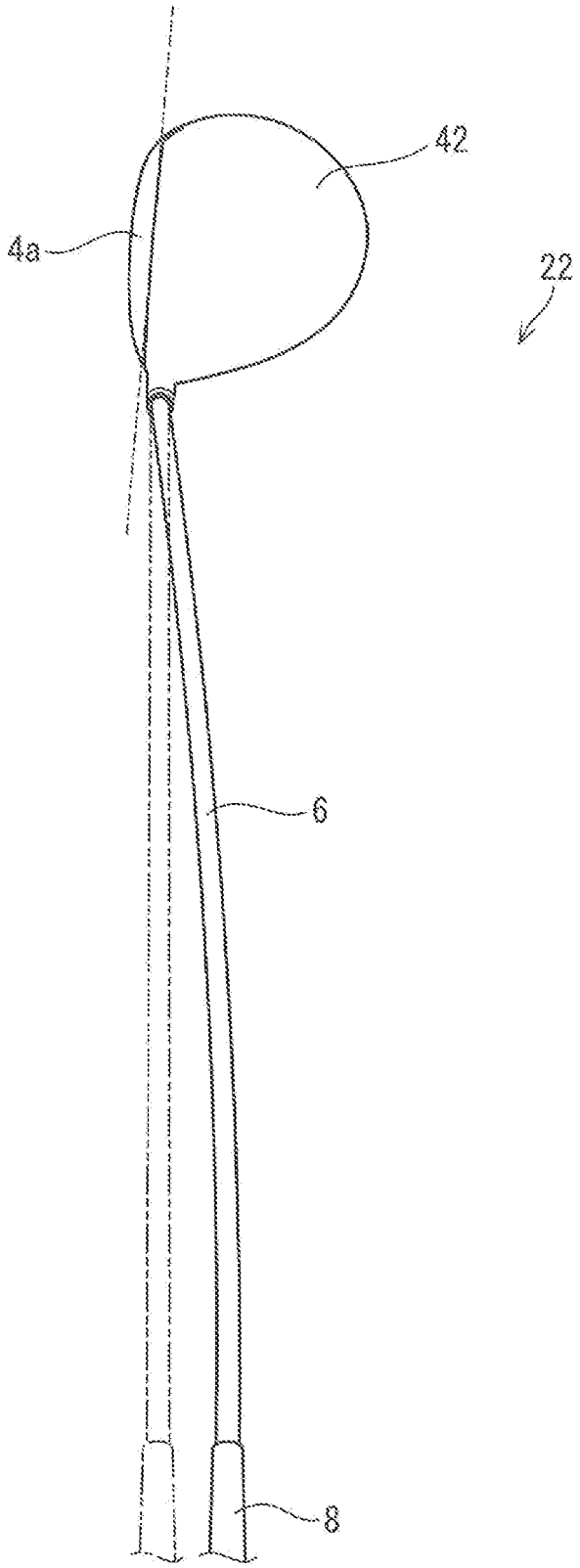
FIG. 5 is a conceptual diagram showing a state where a face is open because of an insufficient head-preceding bending of a shaft.
Figure 6:
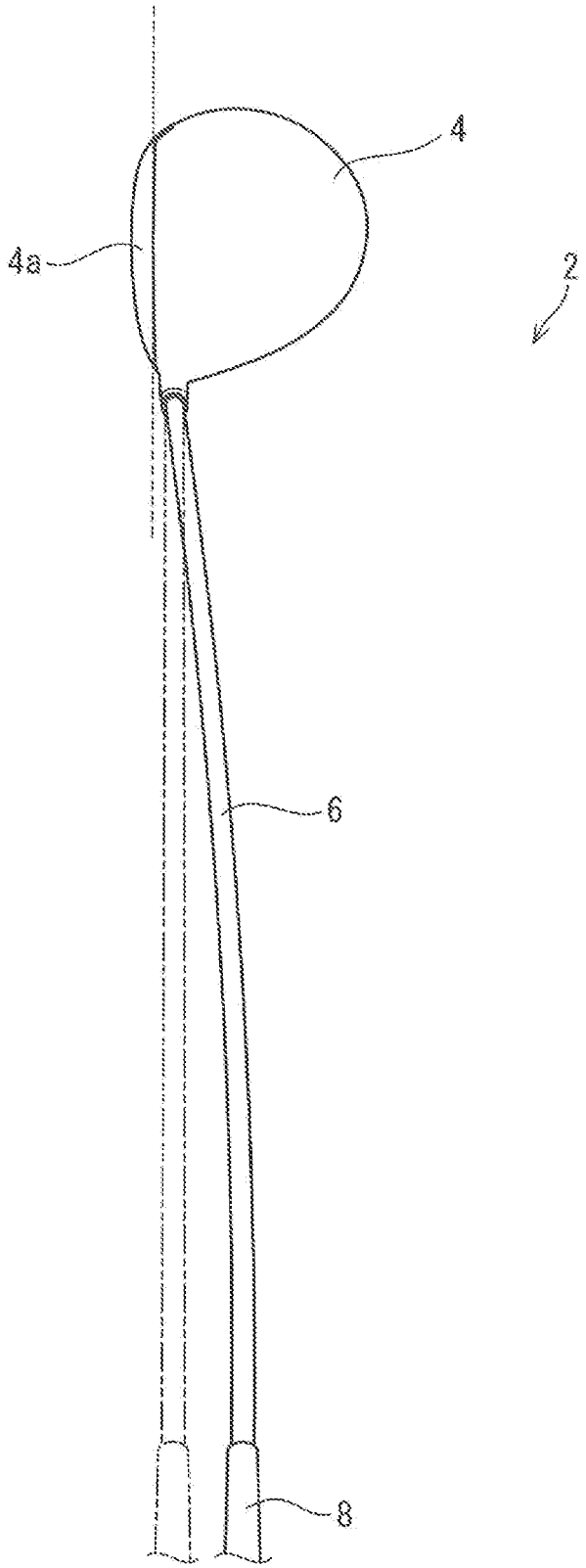
FIG. 6 is a conceptual diagram showing a state where square impact is achieved even when the head-preceding bending of the shaft is insufficient.

FIGS. 4 to 6 show examples of the state of a golf club at impact. FIGS. 4 to 6 each show the state of a golf club viewed by a golfer who swings the golf club. In FIGS. 4 to 6, for the sake of reference, an unbent state of the shaft of each golf club is also depicted with virtual lines. Also, in FIGS. 4 to 6, the orientation of the hitting face 4*a* of each golf club is indicated with a dashed line.

A swinging motion starts from backswing, then transitions from the top of swing to downswing, and reaches impact. In an initial stage of the downswing, angular acceleration of the swing is high, and the shaft is thus largely bent. At this time, the shaft bends in such a manner that the head follows the shaft with respect to the swing direction. Such bending is also referred to as "head-following bending". In reaction to this head-following bending, the bent shaft returns to the unbent state (hereinafter this phenomenon is referred to as "bending return"). Such bending return gradually alleviates the head-following bending and further causes "head-preceding bending". The head-preceding bending means bending toward a direction opposite to the direction of the head-following bending. In the head-preceding bending, the shaft bends in such a manner that the head precedes the shaft with respect to the swing direction. Normally, the shaft is in the state of head-preceding bending at impact.

Preceding of the head 4 during the head-preceding bending causes the head 4 to be turned. Ideal head-preceding bending prevents the hitting face 4*a* from opening at impact. Ideal head-preceding bending causes the hitting face 4*a* to be aligned at a right angle to a target direction, thereby allowing a square impact to be achieved.

In FIG. 4, a shaft 61 is in a state of head-preceding bending. FIG. 4 shows ideal impact. In a golf club 21 shown in FIG. 4, the shaft 61 exhibits sufficient head-preceding bending. Accordingly, a head 41 is turned sufficiently, whereby square impact is achieved.

In FIG. 5, a shaft 6 is also in the state of head-preceding bending. However, in FIG. 5, the head-preceding bending is not sufficient. Accordingly, a head 42 is not turned sufficiently, whereby a hitting face 4*a* is open.

The shaft 6 shown in FIG. 5 has a large forward flex f1. Accordingly, the shaft 6 exhibits a high degree of head-following bending in the initial stage of the downswing. Owing to the high degree of head-following bending, the swing path of a club 22 becomes closer to the golfer's body. Accordingly, the effective moment of inertia of the club about a swing rotation axis is reduced, whereby the head speed is improved. Meanwhile, the high degree of head-following bending causes a delayed timing of bending return. Accordingly, impact occurs at a timing when bending return is not sufficient, and this incurs insufficient head-preceding bending. As a result, in the club 22 shown in FIG. 5, the hitting face 4*a* is open at impact although the head speed is high.

In FIG. 6, a shaft 6 is also in the state of head-preceding bending. This shaft 6 is the same as the shaft 6 of the golf club 22 shown in FIG. 5 and has a large forward flex f1. Accordingly, in the golf club 2, head-preceding bending at impact is insufficient although the head speed is improved, similarly to the case of the golf club 22.

However, despite the insufficient head-preceding bending, the golf club 2 shown in FIG. 6 achieves square impact. In the golf club 2, the head 4 tends to be turned owing to an effect caused by the position of the center of gravity of the head 4. This effect compensates for the insufficiency of head-preceding bending, whereby the opening of the hitting face 4*a* is suppressed. As described above, the golf club 2 of the present embodiment achieves a high head speed and also suppresses the opening of the hitting face 4*a*. The golf club 2 is superior in flight distance performance.

The inventors of the present disclosure have found out that "toe-down" and "back-down" occur at impact. The toe-down is a phenomenon in which the toe side of the head 4 is lowered (see an arrow TD in FIG. 1). In the toe-down, the toe side of the head 4 is lowered and the heel side of the head 4 is raised. The back-down is a phenomenon in which the back side of the head 4 is lowered (see an arrow BD in FIG. 2). In the back-down, the back side of the head 4 is lowered and the face side of the head 4 is raised.

The inventors have found out that, owing to the toe-down, opening of the hitting face 4*a* is likely to occur. This is presumably because, as a result of the toe-down, a line normal to the hitting face 4*a* is directed toward an open direction (in which the hitting face 4*a* is open). By suppressing the toe-down, opening of the hitting face 4*a* is suppressed. By reducing the center-of-gravity distance B, the toe-down is suppressed, whereby opening of the hitting face 4*a* is suppressed.

The inventors have further found out that the back-down causes the hitting face 4*a* to close. It is clear that the back-down increases the loft angle (impact loft) with respect to the vertical direction. However, it has been found out that such back-down increases the impact loft and also causes the hitting face 4*a* to close at the same time. Presumably, this is caused by an influence of the centrifugal force acting on the head center of gravity G1. By accelerating the back-down, opening of the hitting face 4*a* is suppressed. By increasing the center-of-gravity depth C, the back-down is accelerated, whereby opening of the hitting face 4*a* is suppressed.

The square impact means that a line normal to the face 4*a* is directed to a target direction at impact. In the square impact, the face 4*a* is neither opened nor closed.

From the viewpoint of reducing the toe-down and suppressing opening of the face 4*a*, the center-of-gravity distance B is preferably less than or equal to 39 mm, more preferably less than or equal to 37.0 mm, and still more preferably less than or equal to 35.0 mm. Considering a required size of the head, there is a limit to the reduction of the center-of-gravity distance B. From this viewpoint, the center-of-gravity distance B is preferably greater than or equal to 23.0 mm, more preferably greater than or equal to 25.0 mm, and still more preferably greater than or equal to 27.0 mm.

From the viewpoint of increasing the back-down and causing the face 4*a* to close easily, the center-of-gravity depth C is preferably greater than or equal to 23.5 mm, more preferably greater than or equal to 25.0 mm, and still more preferably greater than or equal to 26.5 mm. Considering the head dimensions, there is a limit to the increase of the center-of-gravity depth C. From this viewpoint, the center-of-gravity depth C is preferably less than or equal to 42.0 mm, more preferably less than or equal to 40.0 mm, and still more preferably less than or equal to 38.0 mm.

From the viewpoint of suppressing the toe-down while accelerating the back-down, the ratio of the center-of-gravity depth C to the center-of-gravity distance B [the center-of-gravity depth C/the center-of-gravity distance B] is preferably set large. The ratio [the center-of-gravity depth C/the center-of-gravity distance B] is preferably greater than or equal to 0.64, more preferably greater than or equal to 0.68, and still more preferably greater than or equal to 0.71. Considering the limit of the center-of-gravity depth C and the center-of-gravity distance B due to the head dimensions, the ratio [the center-of-gravity depth C/the center-of-gravity distance B] is preferably less than or equal to 0.85, more preferably less than or equal to 0.83, and still more preferably less than or equal to 0.81.

From the viewpoint of increasing the head speed by bringing the path of the club and the path of the head close to the golfer's body, the forward flex f1 is preferably greater than or equal to 110 mm, more preferably greater than or equal to 120 mm, still more preferably greater than or equal to 130 mm, and yet more preferably greater than or equal to 135 mm. From the viewpoint of bending return, the forward flex f1 is preferably less than or equal to 175 mm, more preferably less than or equal to 170 mm, and still more preferably less than or equal to 165 mm.

When the ratio f2/f1 is excessively large, the tip portion of the shaft is too flexible, resulting in delayed bending return. From this viewpoint, f2/f1 is preferably less than or equal to 0.9, more preferably less than or equal to 0.89, and still more preferably less than or equal to 0.88. When f2/f1 is excessively small, the tip portion of the shaft is too rigid, whereby the back-down is lessened and the effect of closing the face 4*a* is reduced. From this viewpoint, f2/f1 is preferably greater than or equal to 0.80, more preferably greater than or equal to 0.81, and still more preferably greater than or equal to 0.82.

In a long club, the degree of bending is high and its face is less likely to be turned. Accordingly, the technique of the present disclosure is effective in a long club such as a driver. From this viewpoint, the head volume is preferably greater than or equal to 380 cc, more preferably greater than or equal to 400 cc, and still more preferably greater than or equal to 420 cc. From the viewpoint of the rules of golf, the head volume is preferably less than or equal to 470 cc, more preferably less than or equal to 465 cc, and still more preferably less than or equal to 460 cc.

As described above, the technique of the present disclosure is effective in a long club such as a driver. From this viewpoint, the club length is preferably greater than or equal to 43 inches, more preferably greater than or equal to 44 inches, and still more preferably greater than or equal to 45 inches. From the viewpoint of the rules of golf and ease of swinging, the club length is preferably less than or equal to 48 inches, more preferably less than or equal to 47 inches, and still more preferably less than or equal to 46 inches. The club length is measured in accordance with the rules prescribed by the Royal and Ancient Golf Club of Saint Andrews (R&A). These rules are described in "1c Length" in "1 Clubs" of "Appendix II Design of Clubs" of the latest version of Rules of Golf issued by the R&A. The measurement of a club length in accordance with these rules is carried out by placing a club on a horizontal plane and setting a sole against a plane that forms an angle of 60 degrees with the horizontal plane. Accordingly, such a measurement method is also referred to as a "60-degree measurement method".

Considering the preferable range of the club length, the shaft length is preferably greater than or equal to 42.5 inches, more preferably greater than or equal to 43.5 inches, and still more preferably greater than or equal to 44.5 inches. Considering the preferable range of the club length, the shaft length is preferably less than or equal to 47.5 inches, more preferably less than or equal to 46.5 inches, and still more preferably less than or equal to 45.5 inches.

From the viewpoint of increasing the head speed, the shaft weight is preferably less than or equal to 50 g, more preferably less than or equal to 48 g, and still more preferably less than or equal to 47 g. Considering the strength of the shaft, the shaft weight is preferably greater than or equal to 25 g, more preferably greater than or equal to 28 g, and still more preferably greater than or equal to 32 g.

From the viewpoint of increasing the head speed, the head weight is preferably less than or equal to 202 g, more preferably less than or equal to 201 g, and still more preferably less than or equal to 200 g. From the viewpoint of increasing the kinetic energy of the head and increasing the initial velocity of a ball, the head weight is preferably greater than or equal to 180 g, more preferably greater than or equal to 182 g, and still more preferably greater than or equal to 184 g.

Considering the preferable head weight, the club weight is preferably greater than or equal to 270 g, more preferably greater than or equal to 275 g, and still more preferably greater than or equal to 277 g. From the viewpoint of ease of swinging, the club weight is preferably less than or equal to 302 g, more preferably less than or equal to 298 g, and still more preferably less than or equal to 296 g.

A shaft torque means a torsional angle formed when a predetermined torque is applied to a shaft. The greater the shaft torque, the more likely the shaft is to twist.

By increasing the shaft torque, the effect of the back-down to close a face can be enhanced. From this viewpoint, the shaft torque is preferably greater than or equal to 5.0°, more preferably greater than or equal to 5.3°, and still more preferably greater than or equal to 5.6°. From the viewpoint of the directional stability of a ball hit by the club, the shaft torque is preferably less than or equal to 7.5°, more preferably less than or equal to 7.3°, and still more preferably less than or equal to 7.2°.

Figure 8:
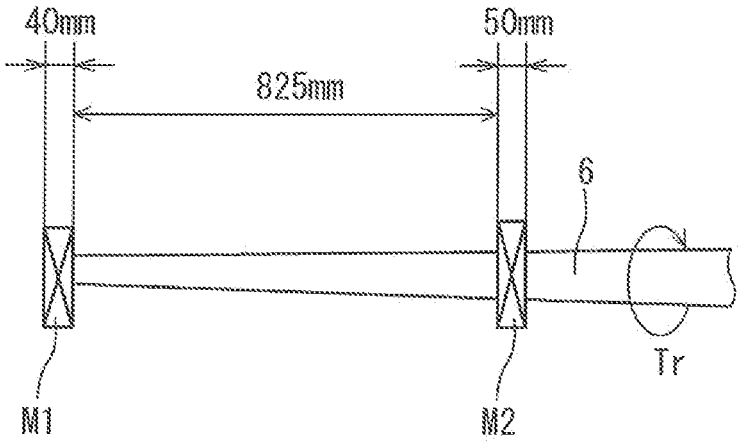
FIG. 8 is a schematic diagram illustrating a method for measuring a shaft torque.

FIG. 8 is a schematic diagram illustrating a method for measuring a shaft torque. A portion of the shaft extending from the tip end Tp to a position spaced 40 mm apart from the tip end Tp is fixed with a jig M1. The fixing is accomplished by means of a pneumatic chuck, and the pneumatic pressure of the pneumatic chuck is 2.0 kgf/cm$^2$. A jig M2 is fixed to a portion of the shaft extending from a position spaced 825 mm apart from the jig M1 toward the butt end Bt side and having a width of 50 mm. The fixing is accomplished by means of a pneumatic chuck, and the pneumatic pressure of the pneumatic chuck is 1.5 kgf/cm$^2$. A torque Tr of 13.9 kg·cm is applied to the shaft 6 by rotating the jig M2 with the jig M1 remained fixed. The torsional angle formed by applying the torque Tr is the shaft torque.

EXAMPLES

Although advantageous effects of the present disclosure are demonstrated by the following examples, the present disclosure should not be construed restrictively on the basis of the descriptions of the examples.

Example 1

A driver head made of a titanium alloy was obtained by joining a forged face member and a casted body member by welding. A shaft was obtained by a sheet winding method using a plurality of prepreg sheets. A grip was obtained by heating and pressurizing a rubber composition in a mold. A golf club was obtained by attaching the grip and the head to the shaft. The club length was set to 45.75 inches, the club weight was set to 280 g, the head weight was set to 196 g, the head volume was set to 460 cc, the shaft weight was set to 37 g, and the real loft angle was set to 11.5 degrees. Table 1 below shows the specifications and the evaluation results of the golf club of Example 1.

Other Examples and Comparative Examples

Golf clubs according to other examples and comparative examples were obtained in the same manner as in Example 1, except that the specifications of these golf clubs were set as shown in Tables 1 to 5 below. The golf clubs of all the examples and the comparative examples had heads with the same configuration. The position of the center of gravity of each of the head was adjusted by adjusting the position of an adhesive injected to the interior of the head. The specifications of each of the shafts was adjusted by changing the position, dimensions, and type of each of the prepregs.

Tables 1 to 5 below show the specifications and the evaluation results of the golf clubs of the examples and the comparative examples.

TABLE 1

Specifications and evaluation results of examples and comparative examples

| | Unit | Comp. Ex. 1 | Ex. 1 | Ex. 2 | Ex. 3 |
|---|---|---|---|---|---|
| Center-of-gravity depth C | mm | 22.0 | 23.5 | 25.0 | 26.5 |
| Center-of-gravity distance B | mm | 37.0 | 37.0 | 37.0 | 37.0 |
| Center-of-gravity depth C/center-of-gravity distance B | — | 0.59 | 0.64 | 0.68 | 0.72 |
| Forward flex f1 | mm | 130 | 130 | 130 | 130 |
| Backward flex f2 | mm | 112 | 112 | 112 | 112 |
| f2/f1 | — | 0.86 | 0.86 | 0.86 | 0.86 |
| Shaft torque | degree | 6.5 | 6.5 | 6.5 | 6.5 |
| Toe-down angle | degree | 4.5 | 4.5 | 4.5 | 4.5 |
| Back-down angle | degree | 2.7 | 2.9 | 3.0 | 3.2 |
| Direction of hitting face at impact | degree | −1.0 | −0.9 | −0.8 | −0.7 |
| H/S | m/s | 37.0 | 37.1 | 37.1 | 37.2 |
| Flight distance | yards | 180.0 | 180.4 | 180.7 | 181.1 |

TABLE 2

Specifications and evaluation results of examples and comparative examples

| | Unit | Comp. Ex. 2 | Ex. 4 | Ex. 2 | Ex. 5 |
|---|---|---|---|---|---|
| Center-of-gravity depth C | mm | 25.0 | 25.0 | 25.0 | 25.0 |
| Center-of-gravity distance B | mm | 41.0 | 39.0 | 37.0 | 35.0 |
| Center-of-gravity depth C/center-of-gravity distance B | — | 0.61 | 0.64 | 0.68 | 0.71 |
| Forward flex f1 | mm | 130 | 130 | 130 | 130 |
| Backward flex f2 | mm | 112 | 112 | 112 | 112 |
| f2/f1 | — | 0.86 | 0.86 | 0.86 | 0.86 |
| Shaft torque | degree | 6.5 | 6.5 | 6.5 | 6.5 |
| Toe-down angle | degree | 5.0 | 4.7 | 4.5 | 4.3 |
| Back-down angle | degree | 3.0 | 3.0 | 3.0 | 3.0 |
| Direction of hitting face at impact | degree | −0.9 | −0.9 | −0.8 | −0.8 |
| H/S | m/s | 37.1 | 37.1 | 37.1 | 37.1 |
| Flight distance | yards | 180.6 | 180.7 | 180.7 | 180.8 |

TABLE 3

Specifications and evaluation results of examples and comparative examples

| | Unit | Comp. Ex. 3 | Ex. 6 | Ex. 7 | Ex. 8 |
|---|---|---|---|---|---|
| Center-of-gravity depth C | mm | 25.0 | 25.0 | 25.0 | 25.0 |
| Center-of-gravity distance B | mm | 37.0 | 37.0 | 37.0 | 37.0 |
| Center-of-gravity depth C/center-of-gravity distance B | — | 0.68 | 0.68 | 0.68 | 0.68 |
| Forward flex f1 | mm | 102 | 110 | 140 | 150 |
| Backward flex f2 | mm | 112 | 113 | 125 | 130 |
| f2/f1 | — | 1.10 | 1.03 | 0.89 | 0.87 |
| Shaft torque | degree | 6.5 | 6.5 | 6.5 | 6.5 |
| Toe-down angle | degree | 4.5 | 4.5 | 4.5 | 4.5 |
| Back-down angle | degree | 3.0 | 3.0 | 3.0 | 3.0 |
| Direction of hitting face at impact | degree | −1.4 | −1.3 | −1.1 | −1.1 |
| H/S | m/s | 36.9 | 37.0 | 37.3 | 37.5 |
| Flight distance | yards | 179.3 | 179.7 | 181.2 | 181.7 |

TABLE 4

Specifications and evaluation results of examples and comparative examples

| | Unit | Ex. 9 | Ex. 10 | Ex. 11 | Ex. 12 |
|---|---|---|---|---|---|
| Center-of-gravity depth C | mm | 25.0 | 25.0 | 25.0 | 25.0 |
| Center-of-gravity distance B | mm | 37.0 | 37.0 | 37.0 | 37.0 |
| Center-of-gravity depth C/center-of-gravity distance B | — | 0.68 | 0.68 | 0.68 | 0.68 |
| Forward flex f1 | mm | 130 | 130 | 130 | 130 |
| Backward flex f2 | mm | 95 | 104 | 116 | 121 |
| f2/f1 | — | 0.73 | 0.80 | 0.89 | 0.93 |
| Shaft torque | degree | 6.5 | 6.5 | 6.5 | 6.5 |
| Toe-down angle | degree | 4.5 | 4.5 | 4.5 | 4.5 |
| Back-down angle | degree | 3.0 | 3.0 | 3.0 | 3.0 |
| Direction of hitting face at impact | degree | −0.1 | −0.5 | −1.0 | −1.2 |
| H/S | m/s | 37.0 | 37.1 | 37.2 | 37.2 |
| Flight distance | yards | 180.8 | 180.8 | 180.7 | 180.7 |

TABLE 5

Specifications and evaluation results of examples and comparative examples

| | Unit | Ex. 13 | Ex. 14 | Ex. 15 | Ex. 16 |
|---|---|---|---|---|---|
| Center-of-gravity depth C | mm | 25.0 | 25.0 | 25.0 | 25.0 |
| Center-of-gravity distance B | mm | 37.0 | 37.0 | 37.0 | 37.0 |
| Center-of-gravity depth C/center-of-gravity distance B | — | 0.68 | 0.68 | 0.68 | 0.68 |
| Forward flex f1 | mm | 130 | 130 | 130 | 130 |
| Backward flex f2 | mm | 112 | 112 | 112 | 112 |
| f2/f1 | — | 0.86 | 0.86 | 0.86 | 0.86 |
| Shaft torque | degree | 4.5 | 5.0 | 5.5 | 6.0 |
| Toe-down angle | degree | 4.5 | 4.5 | 4.5 | 4.5 |
| Back-down angle | degree | 3.0 | 3.0 | 3.0 | 3.0 |
| Direction of hitting face at impact | degree | −1.8 | −1.6 | −1.3 | −1.1 |
| H/S | m/s | 37.1 | 37.1 | 37.1 | 37.1 |
| Flight distance | yards | 179.7 | 180.0 | 180.2 | 180.5 |

[Evaluation Method]

The evaluations were made in the following manner.

[Toe-Down Angle and Back-Down Angle]

The club was set in a swing robot, and the club was swung at a head speed of 37 m/s. The head at an impact position was photographed to obtain images. The photographed images were a front image photographed from the front of the head, a side image photographed from the toe side of the head, and a top image photographed from the upper side of the head. Also, when the set club was at an addressing position, the head was photographed in the same manner. In the front images, an angle formed between the center line of the hosel when the club was at the addressing position and the center line of the hosel when the club was at the impact position was calculated. This angle is defined as a toe-down angle. In the side images, an angle formed between the center line of the hosel when the club was at the addressing position and the center line of the hosel when the club was at the impact position was calculated. This angle is defined as a back-down angle. These angles are shown in Tables 1 to 5.

[Direction of Face at Impact]

In the top image, an angle formed between a line normal to the hitting face at the face center position and the target direction was calculated. This angle is indicated as a positive value in the case of a closed face with the hitting face directed leftward with respect to the target direction. This angle is indicated as a negative value in the case of an open face with the hitting face directed rightward with respect to the target direction. In Tables 1 to 5, the thus-obtained value is indicated as the direction of the face at impact.

The club was set in the swing robot in such a manner that the direction of the hitting face was aligned with the target direction. That is, in addressing, the direction of the face was 0 degrees. The settings of the swing robot were set to be the same for all the clubs such that all the clubs were swung in the same manner. As the swing robot, a product named "COMPUTER CONTROLLED HITTING MACHINE" manufactured by Golf Laboratories, Inc. was used.

[Flight Distance]

The flight distance is a distance to where a ball hit by the club finally arrives and includes a distance by which the ball runs on the ground. Five testers with a handicap from 10 to 20 each hit a ball five times using each of the clubs. The flight distance shown in Tables 1 to 5 above is an average value of all the measured values.

By shooting photographs of the actual swings, the occurrence of the toe-down and the back-down was confirmed. Further, it has been found that the face opening was suppressed by suppressing the toe-down. It has also been found out that accelerating the back-down caused the face to close. It has been confirmed that, owing to these effects, the opening of the face was suppressed even when the forward flex f1 was large.

These evaluation results demonstrate the superiority of the present disclosure.

Regarding the above-described embodiment, the following clauses are disclosed.

[Clause 1]

A golf club including:

a head;

a shaft; and a grip, wherein the head has a center-of-gravity depth of greater than or equal to 23.5 mm, the head has a center-of-gravity distance of less than or equal to 39 mm, and the shaft has a forward flex of greater than or equal to 110 mm.

[Clause 2]

The golf club according to clause 1, wherein, when f1 denotes the forward flex of the shaft and f2 denotes a backward flex of the shaft, f2/f1 is greater than or equal to 0.8 and less than or equal to 0.9.

[Clause 3]

The golf club according to clause 1 or 2, wherein the head has a volume of greater than or equal to 380 cc.

[Clause 4]

The golf club according to any one of clauses 1 to 3, wherein the shaft has a weight of less than or equal to 50 g.

[Clause 5]

The golf club according to any one of clauses 1 to 4, wherein the head has a weight of less than or equal to 202 g.

[Clause 6]

The golf club according to any one of clauses 1 to 5, wherein the golf club has a weight of greater than or equal to 270 g.

[Clause 7]

The golf club according to any one of clauses 1 to 6, wherein the shaft has a shaft torque of greater than or equal to 5.0 degrees.

LIST OF REFERENCE NUMERALS

2 Golf club
4 Head
4*a* Hitting face
6 Shaft
Z Center line of shaft
Tp Tip end of shaft
Bt Butt end of shaft The above descriptions are merely illustrative and various modifications can be made without departing from the principles of the present disclosure.

What is claimed is:

1. A golf club comprising:

a head;

a shaft; and a grip, wherein the head has a center-of-gravity depth of greater than or equal to 23.5 mm, the head has a center-of-gravity distance of less than or equal to 39 mm, the shaft has a forward flex of greater than or equal to 110 mm, the shaft has a weight of less than or equal to 50 g, and wherein the shaft has a shaft torque of greater than or equal to 5.3 degrees, wherein the shaft torque is a torsional angle formed when a torque of 13.9 kg·cm is applied to a portion of the shaft extending from a first position spaced 40 mm apart from a tip end of the shaft to a second position 825 mm apart from the first position.

2. The golf club according to claim 1, wherein the head has a volume of greater than or equal to 380 cc.

3. The golf club according to claim 1, wherein the head has a weight of less than or equal to 202 g.

4. The golf club according to claim 1, wherein the golf club has a weight of greater than or equal to 270 g.

5. The golf club according to claim 1, wherein the center-of-gravity distance is a distance between a center line of the shaft and a center of gravity of the head measured in a front view of the head.

6. The golf club according to claim 5, wherein the center-of-gravity depth is a distance between the center line of the shaft and the center of gravity of the head measured in a face-back direction.

7. The golf club according to claim 6, wherein the center-of-gravity depth is greater than or equal to 25.0 mm.

8. The golf club according to claim 6, wherein the center-of-gravity distance is less than or equal to 37.0 mm.

9. A golf club comprising:

a head;

a shaft; and a grip, wherein the head has a center-of-gravity depth of greater than or equal to 23.5 mm, the head has a center-of-gravity distance of less than or equal to 39 mm, the shaft has a forward flex of greater than or equal to 110 mm, the center-of-gravity distance is a distance between a center line of the shaft and a center of gravity of the head measured in a front view of the head, the center-of-gravity depth is a distance between the center line of the shaft and the center of gravity of the head measured in a face-back direction, a ratio of the center-of-gravity depth to the center-of-gravity distance [the center-of-gravity depth/the center-of-gravity distance] is greater than or equal to 0.64, and wherein the shaft has a shaft torque of greater than or equal to 5.3 degrees, wherein the shaft torque is a torsional angle formed when a torque of 13.9 kg·cm is applied to a portion of the shaft extending from a first position spaced 40 mm apart from a tip end of the shaft to a second position 825 mm apart from the first position.

10. The golf club according to claim 9, wherein a ratio of the center-of-gravity depth to the center-of-gravity distance [the center-of-gravity depth/the center-of-gravity distance] is greater than or equal to 0.68.

11. A golf club comprising:

a head;

a shaft; and a grip, wherein the head has a center-of-gravity depth of greater than or equal to 23.5 mm, the head has a center-of-gravity distance of less than or equal to 39 mm, the shaft has a forward flex of greater than or equal to 120 mm, and wherein the shaft has a shaft torque of greater than or equal to 5.3 degrees, wherein the shaft torque is a torsional angle formed when a torque of 13.9 kg·cm is applied to a portion of the shaft extending from a first position spaced 40 mm apart from a tip end of the shaft to a second position 825 mm apart from the first position.

12. The golf club according to claim 11, wherein the center-of-gravity distance is a distance between a center line of the shaft and a center of gravity of the head measured in a front view of the head.

13. The golf club according to claim 12, wherein the center-of-gravity depth is a distance between the center line of the shaft and the center of gravity of the head measured in a face-back direction.

14. The golf club according to claim 13, wherein the center-of-gravity depth is greater than or equal to 25.0 mm.

15. The golf club according to claim 13, wherein the center-of-gravity distance is less than or equal to 37.0 mm.

16. The golf club according to claim 13, wherein a ratio of the center-of-gravity depth to the center-of-gravity distance [the center-of-gravity depth/the center-of-gravity distance] is greater than or equal to 0.64.

* * * * *